US008454297B2

(12) United States Patent
Congiu et al.

(10) Patent No.: US 8,454,297 B2
(45) Date of Patent: Jun. 4, 2013

(54) METHOD FOR DETERMINING THE REMAINING SERVICE LIFE OF A ROTOR OF A THERMALLY LOADED TURBOENGINE

(75) Inventors: Francesco Congiu, Zurich (CH); Andreas Ehrsam, Baden (CH); Wolfgang Franz Dietrich Mohr, Niederweningen (CH); Paolo Ruffino, Fislisbach (CH); Peter Weiss, Sulz (CH)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 12/766,437

(22) Filed: Apr. 23, 2010

(65) Prior Publication Data

US 2010/0296918 A1 Nov. 25, 2010

Related U.S. Application Data

(63) Continuation of application No. PCT/EP2008/064415, filed on Oct. 24, 2008.

(30) Foreign Application Priority Data

Nov. 2, 2007 (CH) ..... 1717/07

(51) Int. Cl.
*F01D 25/00* (2006.01)

(52) U.S. Cl.
USPC ..... 415/1; 415/118; 415/220

(58) Field of Classification Search
USPC ..... 415/47, 48, 118
See application file for complete search history.

(56) References Cited

U.S. PATENT DOCUMENTS

| | | | | | |
|---|---|---|---|---|---|
| 3,696,678 | A * | 10/1972 | Mossey | 374/104 |
| 4,303,369 | A * | 12/1981 | Hisano et al. | 415/47 |
| 4,722,062 | A * | 1/1988 | Breitkopf et al. | 374/144 |
| 4,796,465 | A | 1/1989 | Carreno et al. | |
| 6,364,524 | B1 * | 4/2002 | Markham | 374/131 |
| 6,449,565 | B1 * | 9/2002 | Budrow et al. | 702/42 |
| 6,796,709 | B2 * | 9/2004 | Choi | 416/61 |
| 7,267,525 | B2 | 9/2007 | Hiegemann et al. | |
| 7,448,853 | B2 * | 11/2008 | Mabe et al. | 416/1 |
| 7,454,297 | B2 * | 11/2008 | Balestra | 702/42 |
| 7,949,479 | B2 * | 5/2011 | Brown et al. | 702/34 |
| 2004/0101023 | A1 | 5/2004 | Choi | |

FOREIGN PATENT DOCUMENTS

| | | | |
|---|---|---|---|
| EP | 1088965 | A1 | 4/2001 |
| EP | 1418312 | A2 | 5/2004 |
| EP | 1536102 | A2 | 6/2005 |
| JP | 62000835 | A * | 1/1987 |
| JP | 63117102 | A | 5/1988 |
| JP | 6200701 | A | 7/1994 |
| JP | 7217407 | A | 8/1995 |
| WO | 8101441 | A1 | 5/1981 |

* cited by examiner

*Primary Examiner* — Ninh H Nguyen
(74) *Attorney, Agent, or Firm* — Volpe and Koenig, P.C.

(57) ABSTRACT

A method for determining the remaining service life of a rotor of a thermally loaded turboengine in which a temperature on the rotor is determined. Thermal stress on the rotor is calculated from the determined temperature, and the remaining service life of the rotor is calculated from the derived thermal stress. The temperature is measured directly at a predetermined point of the rotor, and the thermal stress on the rotor is derived from the measured temperature.

14 Claims, 1 Drawing Sheet

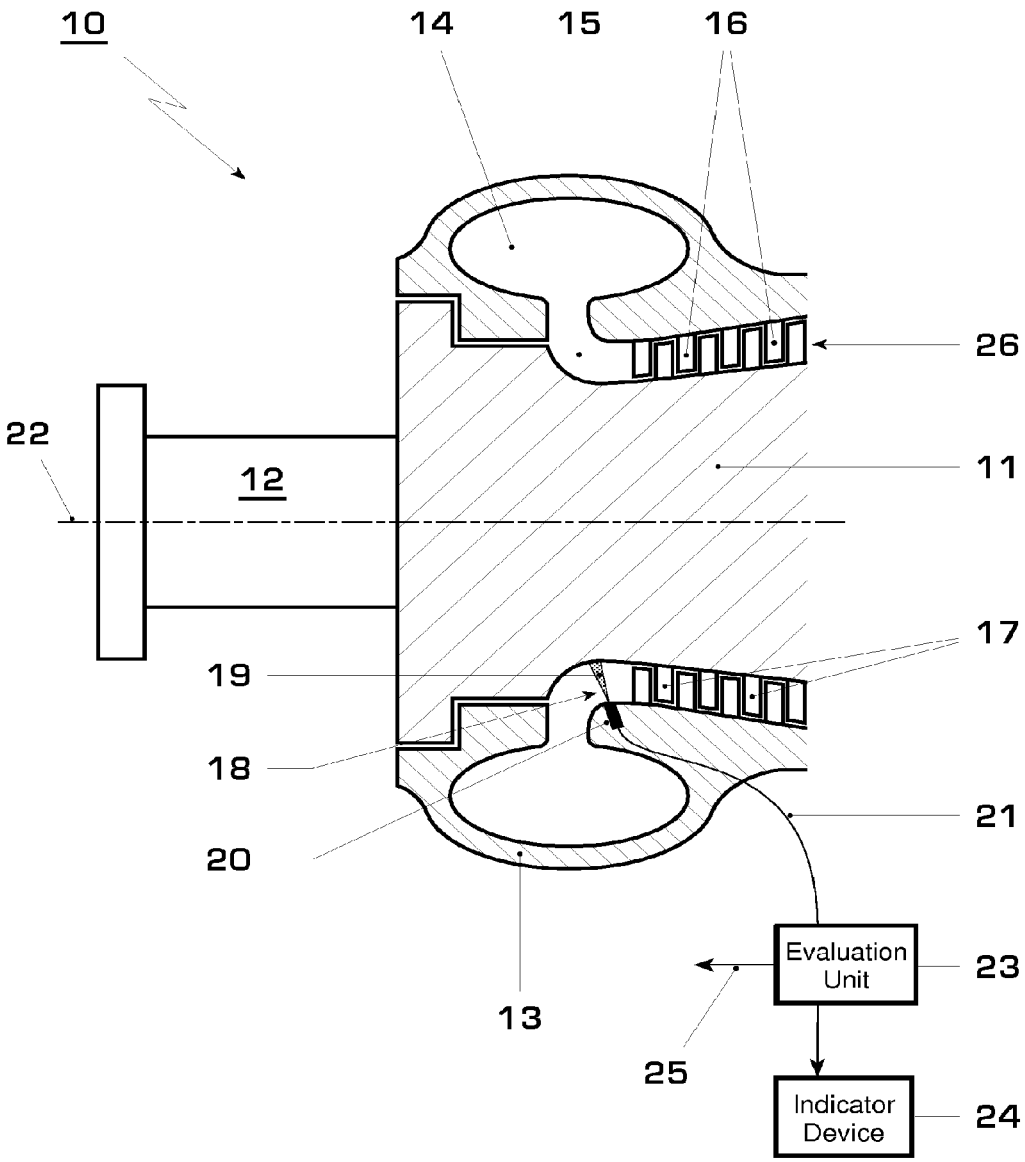
10
14
15
16
26
22
12
11
17
19
18
21
20
Evaluation Unit
23
13
25
Indicator Device
24

METHOD FOR DETERMINING THE REMAINING SERVICE LIFE OF A ROTOR OF A THERMALLY LOADED TURBOENGINE

CROSS REFERENCE TO RELATED APPLICATION

This application is a continuation of International Application No. PCT/EP2008/064415 filed Oct. 24, 2008, which claims priority to Swiss Patent Application No. 01717/07, filed Nov. 2, 2007, the entire contents of all of which are incorporated by reference as if fully set forth.

FIELD OF INVENTION

The present invention relates to the field of thermally loaded turboengines. It refers to a method for determining the remaining service life of a rotor of a thermally loaded turboengine and an arrangement for carrying out this method.

BACKGROUND

It is well known that an appreciable impairment in the service life of rotors of thermally loaded turboengines, here, but not exclusively, a steam turbine, originates from the high temperature gradients within the rotor material, specifically especially on the turbine inlet. The high temperature gradients are caused by sudden changes in the thermodynamic conditions during transition phases of the turbine of such a turboengine (for example, during start-up or during a shutdown). During start-up, for example, the rotor is still at a low temperature, whereas the working gas, that is to say the steam in the case of a steam turbine, flows into the hot steam duct with high pressure and high temperature. The rotor surface directly exposed to the hot steam is then brought to higher temperatures, whereas the main part of the rotor body is still at the (low) initial value.

This gives rise to a high temperature gradient between the body and surface, which is converted into mechanical stresses. On account of the incessant start-up and shut-down phases of such a steam turbine, especially in modern quick-start combined-cycle power station applications and in turbines with high steam temperatures (Ultra Super Critical USC), the service life of the rotor is reduced due to the cyclic heat stresses (Low Cycle Fatigue LCF). A reliable algorithm for calculating the remaining service life based on the stress in the rotor is therefore dependent on an exact measurement of the temperature in the rotor inlet region.

Hitherto, the rotor temperature has not been measured directly in the inlet region of the turbine. Instead, for example, the temperature has been measured at various points of the inner casing by means of thermoelements, and the corresponding temperature on the rotor has then been determined from this on the basis of a transfer function between the rotor and casing. On the basis of these measurements, the stress in the rotor and, from this, the remaining service life have then been derived. However, such a procedure has certain limits for rapid transient processes, specifically especially for machines which operate at higher than conventional steam temperatures. In this case, account must be taken of the fact that, for example, an excess of 10% in the mechanical stress of the rotor (in combined-cycle power stations with two shifts) may signify a reduction in the service life of 40%.

U.S. Pat. No. 4,796,465 discloses a method and a device for monitoring the material of a turboengine, in particular of a steam turbine, in which material samples are taken from the forgings of the rotor disks or of other turbine parts and, after the final machining of the forgings, are inserted into recesses provided for this purpose. The samples are then exposed, during operation, to the conditions prevailing there. After a predetermined operating time, the samples are removed again and examined for material fatigue or the like, so that the remaining service life of the machine can be determined. This method is highly complicated and is not very flexible in practical terms.

JP-A-6200701 discloses a method for determining the remaining service life of a rotor of a steam turbine, in which the hardness of a high-temperature part of a new rotor is measured at periodic intervals. From this a hardness reduction rate is calculated, from which the service life of the rotor is ultimately derived. This method also requires access to the stationary machine and is therefore complicated and inflexible.

JP-A-7217407 discloses a method and a device for monitoring the service life consumption of a turbine, in which the surface temperature on a casing and on an intermediate portion of the casing thickness is measured, and the thermal stresses are calculated from the difference and compared with calculated limit values. The method is suitable primarily for static components (casings, valves, etc.). This measurement, at most, makes it possible indirectly to draw conclusions as to the remaining service life of the rotor.

JP-A-63117102 discloses a method for determining the service life of a steam turbine in a bore of the rotor, the electrical resistance in a high-temperature part and a low-temperature part of the rotor being measured by means of an electrical resistance sensor displaceable in the bore. The service life of the high-temperature part is then deduced from the difference in the resistances. This difference measurement requires a complicated built-in movement mechanism which is complicated and susceptible to faults during operation and requires considerable additional costs for building it in and for maintenance.

SUMMARY

The disclosure is directed to a method for determining the remaining service life of a rotor of a thermally loaded turboengine. The method includes determining a temperature on the rotor of the turbine and deriving the thermal stress on the rotor from the determined temperature. The method also includes deducing the remaining service life of the rotor from the derived thermal stress. The temperature is measured directly at a predetermined point of the rotor and the thermal stress on the rotor is derived from the measured temperature.

In another aspect, the disclosure deals with an arrangement for carrying out the above method in a thermally highly loaded turboengine or steam turbine. The turboengine or steam turbine includes a rotor mounted rotatably about an axis having a blading extending in the axial direction and which is surrounded by a casing so as to form a hot working gas duct or hot steam duct. A contactlessly operating temperature recorder, which records the temperature at the predetermined point, of the rotor is arranged on the casing.

BRIEF DESCRIPTION OF THE DRAWING

The invention will be explained in more detail below by way of exemplary embodiments, in conjunction with the drawing in which:

FIG. 1 shows a longitudinal section through an exemplary inlet region of a steam turbine with a pyrometer for the contactless measurement of the rotor temperature according to an exemplary embodiment of the invention.

DETAILED DESCRIPTION OF THE PREFERRED EMBODIMENTS

Introduction to the Embodiments

The object of the invention is to specify a method for determining the remaining service life of the rotor of a thermally loaded turboengine, which avoids the disadvantages of known methods and is distinguished by flexibility of use, simplicity in set-up and high operating reliability, and also to provide an arrangement for carrying out the method. Notably, the method for determining the heat stress occurring in a rotor can advantageously be implemented at least for a regulated start-up of turbines, in which case, for example in a steam turbine, the permissible steam parameters at the turbine inlet and at the boiler outlet are determined before and/or during the start-up of the turbine, taking into account the permissible heat stress in the highly loaded turbine parts.

The object is achieved by the whole of the features of the independent claims. The arrangement described herein is not restricted solely to a steam turbine. It is preferred that the temperature is measured directly at one or more predetermined points of the rotor, and that the thermal stress on the rotor is derived from the measured temperature.

According to one refinement of the invention, the measurement of the temperature on the rotor takes place contactlessly, specifically by means of a pyrometer.

Another refinement of the method according to the invention is that the rotor is mounted rotatably about an axis and is surrounded by a casing, in that rows of moving blades, through which the hot working gases flow in the axial direction, are arranged on the rotor one behind the other in the axial direction, in that the working gas is introduced into the blading of the rotor in an inlet region, and in that the temperature on the rotor is measured in the inlet region.

If, in particular, the inlet region is formed by an inflow spiral, formed in the casing and surrounding the axis annularly, for the radial introduction of the hot working gas and by a deflection duct, adjoining the inflow spiral, for deflecting the entering working gas from the radial direction to the axial direction, it is advantageous if the temperature on the rotor is measured in the deflection duct shortly before the start of the blading.

A further refinement is distinguished in that the measurement of the temperature of the rotor takes place from a fixed point on the surrounding casing, in particular the measurement of the temperature of the rotor taking place directly from a point on the surrounding casing which lies opposite in the working gas duct.

A refinement of the arrangement according to the invention is that the temperature recorder is a pyrometer.

In particular, the turboengine has an inlet region for introducing the working gas into the blading of the rotor, the pyrometer being oriented onto a measuring zone of the rotor, said measuring zone lying in the inlet region.

Preferably, the temperature recorder or pyrometer is arranged directly opposite the predetermined point or measuring zone of the rotor on the casing.

It is in this case expedient that the temperature recorder or pyrometer is arranged fixedly on the casing.

Another refinement of the arrangement according to the invention is that the temperature recorder or pyrometer is connected to an evaluation unit which is followed by an indicator device for indicating the remaining service life, the evaluation unit having, in particular, a control output for controlling the operation of the turboengine.

DETAILED DESCRIPTION

According to the present invention, the use of a pyrometer as an input element for a device for monitoring the thermal stress is proposed. As is known, the pyrometer is suitable for the contactless measurement of the temperature on the surface of a solid body, the thermal radiation emitted by the body being recorded. It is thus possible to read off the temperature on the rotor directly where it is especially critical, without an indirect determination on the basis of a transfer function having to be carried out.

FIG. 1 illustrates a steam turbine configuration of the general type provided by EP-A2-1 536 102. FIG. 1 shows the longitudinal section through the inlet region of such a steam turbine, in which, according to an exemplary embodiment, a pyrometer for temperature measurement is arranged. The steam turbine 10 of FIG. 1 comprises a rotor 11 which is rotatable about an axis 22 and which runs out at one end in a rotor shaft 12. The rotor 11 is surrounded concentrically by an (inner) casing 13, there being formed between the rotor 11 and the casing 13 a hot steam duct 26 in which is arranged a blading comprising guide vanes 16 and moving blades 17. The guide vanes 16 are fastened to the casing 13, whereas the moving blades 17 rotate with the rotor 11 about the axis 22.

Hot steam is supplied to the turbine via a concentric inflow spiral 14 formed in the casing 13, is deflected from the radial direction into an axial direction by a deflection duct 15 and passes axially into the hot steam duct 26 having the blading 16, 17, in order to expand there, at the same time performing work. High temperatures prevail in the deflection duct 15, while the high thermal alternating load occurs particularly severely in the rotor region below the first moving blade row, the temperature of the rotor 11 being measured contactlessly in a measuring zone 18 by a pyrometer 20 which is attached fixedly to the casing 13 on the opposite side and onto which the thermal or infrared radiation beam 19 emanating from the measuring zone 18 falls. It goes without saying that, when the rotor 11 is rotating, the measuring zone 18 corresponds at any time point to another surface zone of the rotor 11, depending on the angular position. If the temperature measurement by the pyrometer 20 is synchronized with the rotation of the rotor 11 in a suitable way, temperature measurement can always take place in the same surface zone of the rotor 11. Otherwise, integral measurement over an annular concentric surface portion of the rotor 11 occurs.

The (measured) temperature values recorded by the pyrometer 20 are transmitted via a feed line 21 to an evaluation unit 23 and are evaluated there and converted into values of the thermal stress and, finally of remaining service life. These values can be indicated on an indicator device 24. However, they may also be used, via a control output 25, for controlling the transient states of the steam turbine 10, for example in order to optimize the remaining service life of the rotor 11.

The use of the invention may be incorporated from the outset in new steam turbines. It is also conceivable, however, to retrofit already existing steam turbines with such a device. It is likewise conceivable to provide temperature measurements at a plurality of points or at other points of the steam turbine, in order to refine the determination of the remaining service life. Of course, the above statements are not restricted solely to a steam turbine. Any other thermally loaded turboengine is likewise an integral part of this teaching as to technical action.

LIST OF REFERENCE SYMBOLS

10 Steam turbine
11 Rotor
12 Rotor shaft
13 Casing
14 Inflow spiral
15 Deflection duct
16 Guide vane
17 Moving blade
18 Measuring zone
19 Beam
20 Pyrometer
21 Feed line
22 Axis
23 Evaluation unit
24 Indicator device
25 Control output
26 Hot steam duct

The invention claimed is:

1. A method for determining the remaining service life of a rotor of a thermally loaded turboengine, comprising:

measuring a temperature on the rotor of the turbine;

deriving a thermal stress on the rotor from the measured temperature; and using an evaluation unit to calculate the remaining service life of the rotor from the derived thermal stress, wherein the temperature is measured directly at a predetermined point of the rotor, and the thermal stress on the rotor is derived from the measured temperature, wherein the rotor is mounted rotatably about an axis and is surrounded by a casing, rows of moving blades, through which hot working gas flows in an axial direction, are arranged on the rotor one behind the other in the axial direction, the working gas is introduced into the blading of the rotor in an inlet region, and the temperature on the rotor is measured in the inlet region, the inlet region is formed by an inflow spiral, formed in the casing and surrounding the axis annularly, for the radial introduction of the working gas and by a deflection duct, adjoining the inflow spiral, for deflecting the entering working gas from the radial direction to the axial direction, and the temperature on the rotor is measured in the deflection duct shortly before the start of the blading.

2. The method as claimed in claim 1, wherein the turboengine is a steam turbine.

3. The method as claimed in claim 1, wherein the measurement of the temperature on the rotor takes place contactlessly.

4. The method as claimed in claim 3, wherein the measurement of the temperature on the rotor is carried out by a pyrometer.

5. The method as claimed in claim 1, wherein the measurement of the temperature of the rotor takes place from a fixed point on the surrounding casing.

6. The method as claimed in claim 5, wherein the measurement of the temperature of the rotor takes place directly from a point on the surrounding casing which lies opposite in the working gas duct.

7. An arrangement for carrying out the method as claimed in claim 1 in a thermally highly loaded turboengine or steam turbine which comprises a rotor mounted rotatably about an axis having a blading extending in an axial direction and which is surrounded by a casing so as to form a hot working gas duct or hot steam duct, wherein a contactlessly operating temperature recorder which records the temperature at the predetermined point of the rotor is arranged on the casing.

8. The arrangement as claimed in claim 7, wherein the temperature recorder is a pyrometer.

9. The arrangement as claimed in claim 8, wherein the turboengine or steam turbine comprises an inlet region for introducing the working gas or hot steam into the blading of the rotor, and the pyrometer is oriented onto a measuring zone of the rotor, said measuring zone lying in the inlet region.

10. The arrangement as claimed in claim 7, wherein the temperature recorder is arranged directly opposite the predetermined point or measuring zone of the rotor on the casing.

11. The arrangement as claimed in claim 7, wherein the temperature recorder is arranged fixedly on the casing.

12. The arrangement as claimed in claim 7, wherein the temperature recorder is connected to an evaluation unit.

13. The arrangement as claimed in claim 12, wherein the evaluation unit is followed by an indicator device for indicating the remaining service life.

14. The arrangement as claimed in claim 12, wherein the evaluation unit has a control output for controlling the operation of the turboengine or steam turbine.

* * * * *